US006868242B2

(12) United States Patent
Walgrove, III et al.

(10) Patent No.: US 6,868,242 B2
(45) Date of Patent: Mar. 15, 2005

(54) MECHANISM AND METHOD FOR CLEANING CORONA WIRES

(75) Inventors: George R. Walgrove, III, Rochester, NY (US); Gary B. Bertram, Honeoye Falls, NY (US); Gerald M. Darby, II, Brockport, NY (US); Daniel R. Palmer, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/397,011

(22) Filed: Mar. 25, 2003

(65) Prior Publication Data

US 2003/0180065 A1 Sep. 25, 2003

Related U.S. Application Data

(63) Continuation-in-part of application No. 09/796,321, filed on Feb. 28, 2001, now Pat. No. 6,580,885.

(51) Int. Cl.[7] ..... G03G 15/02
(52) U.S. Cl. ..... 399/100
(58) Field of Search ..... 399/100, 101, 399/170; 250/234, 235, 236; 361/225

(56) References Cited

U.S. PATENT DOCUMENTS

| | | | | | |
|---|---|---|---|---|---|
| 3,842,273 | A | * | 10/1974 | Van Buskirk | 399/100 |
| 4,038,546 | A | * | 7/1977 | Jasinski | 399/100 |
| 5,170,314 | A | | 12/1992 | Saito | |
| 5,182,694 | A | | 1/1993 | Endo | |
| 5,392,099 | A | | 2/1995 | Kusumoto et al. | |
| 5,485,255 | A | * | 1/1996 | Reuschle et al. | 399/168 |
| 5,594,532 | A | | 1/1997 | Tuvesson et al. | |
| 5,697,019 | A | | 12/1997 | Kim | |
| 5,940,656 | A | * | 8/1999 | Hensel | 399/100 |
| 6,108,504 | A | | 8/2000 | Dickhoff | |
| 6,163,664 | A | * | 12/2000 | Hayashi | 399/100 |
| 6,294,782 | B1 | | 9/2001 | Dickhoff | |
| 6,303,933 | B1 | | 10/2001 | Dickhoff | |
| 6,328,250 | B1 | | 12/2001 | Dickhoff | |
| 6,580,885 | B2 | * | 6/2003 | Bertram et al. | 399/100 |

FOREIGN PATENT DOCUMENTS

| | | | | | |
|---|---|---|---|---|---|
| JP | 61-140963 | A | * | 6/1986 | |
| JP | 01-100571 | | | 4/1989 | |
| JP | 02-134655 | | | 5/1990 | |
| JP | 03-267957 | | | 11/1991 | |
| JP | 5-323772 | A | * | 12/1993 | |
| JP | 07271157 | A | * | 10/1995 | G03G/15/02 |
| JP | 7-302676 | A | * | 11/1995 | |
| JP | 09-160357 | | | 6/1997 | |
| JP | 11-24375 | | | 1/1999 | |
| JP | 11249390 | A | * | 9/1999 | G03G/15/02 |
| JP | 11-338265 | A | * | 12/1999 | |
| JP | 2001350328 | A | * | 12/2001 | G03G/15/02 |

* cited by examiner

*Primary Examiner*—Robert Beatty
(74) *Attorney, Agent, or Firm*—Kevin L. Leffel; Richard A. Romanchik

(57) ABSTRACT

The present invention relates in general to a corona charger for use in an electrostatographic reproduction apparatus or the like, and more particularly to a cleaning mechanism for the corona wires of a corona charger. According to one aspect, a corona wire assembly is provided having a corona wire and a cleaning pad with a hole, the corona wire extending through the hole. According to another aspect, a method for cleaning a corona wire is provided wherein relative movement is generated between a corona wire and a cleaning pad having a hole, the corona wire extending through the hole. According to a further aspect, a cleaning mechanism for cleaning the surface of a corona wire within a corona charger is provided having a cleaning pad, a corona wire passing through the cleaning pad and positioning the cleaning pad in at least one direction lateral to the corona wire, and a holding member holding the cleaning pad without restraining the cleaning pad in the at least one direction lateral to the corona wire.

18 Claims, 5 Drawing Sheets

MECHANISM AND METHOD FOR CLEANING CORONA WIRES

This application is a continuation-in-part of and claims the benefit of prior application Ser. No. 09/796,321 filed Feb. 28, 2001, now U.S. Pat. No. 6,580,885 B2 entitled "Automatic Mechanism for Cleaning Corona Wires".

BACKGROUND

The present invention relates in general to a corona charger for use in an electrostatographic reproduction apparatus or the like, and more particularly to a cleaning mechanism for the corona wires of a corona charger.

In typical commercial electrostatographic reproduction apparatus (such as copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member and the image is fixed to the receiver member by heat and/or pressure to form a permanent reproduction thereon.

The electrostatic fields for various reproduction apparatus operations are commonly provided by corona charging devices. For example, corona chargers may be used to deposit the uniform charge on the dielectric member prior to forming the latent image charge pattern, to implement transfer of a developed image from the dielectric member to a receiver member, or to neutralize charge on the dielectric member subsequent to developed image transfer to facilitate release of the receiver member or residual marking particles from the dielectric member.

Corona chargers typically include at least one very thin corona wire, located within a housing shell. The corona wire is electrically coupled to a high voltage potential source to generate ions or charging current to charge a surface (such as the dielectric member surface) brought into close proximity with the corona wire. The corona wire is tightly suspended between insulating end blocks, supported in the housing shell, such end blocks being connected to a high voltage source for producing the ion generating condition around the corona wire. A grid may be located between the corona wire and the surface to be charged. The grid is held at a preselected electrical potential to control the specific charge to be laid down on the surface.

It should be well appreciated that the high voltage of the corona wire creates a corrosive environment which adversely affects the wire. That is, the electrically charged atmosphere surrounding the wire is conducive to the promotion of coating and/or pitting of the wire by airborne marking particles, fuser oil mist, or paper dust. Over time, such action on the corona wire will cause the wire, which by its very nature is extremely fragile, to no longer be effective in producing the desired uniform charging of the surface intended to have a charge applied thereto. That is, irregularities in the corona wires will cause charging irregularities which show up as defects in the reproduction being formed. The defects may typically include streaks, spots or mottle. Accordingly, the corona charger, and particularly its grid and corona wires, has to be periodically cleaned to assure proper operation and prolong its useful life.

One apparatus used for cleaning the corona wires requires the use of a cleaning pad. The disadvantage of using a cleaning pad is that only about half of the surface of the corona wire can be cleaned with a cleaning pad, since the cleaning pad used is flat in shape and does not surround the corona wire. Additionally, in order to clean the corona wire with the cleaning pad, the corona wire is usually stretched and tensed over the cleaning pad, decreasing the life of the corona wire. Accordingly, advances in methods and apparatuses for cleaning a corona wire, are necessary to improve corona wire life.

BRIEF SUMMARY

According to one aspect of the invention, a corona wire assembly is provided comprising a corona wire and a cleaning pad having a hole, the corona wire extending through the hole.

According to a further aspect of the invention, a method for cleaning a corona wire is provided comprising generating relative movement between the corona wire and a cleaning pad having a hole, the corona wire extending through the hole.

According to a further aspect of the invention, a cleaning mechanism for cleaning the surface of a corona wire within a corona charger is provided comprising a cleaning pad, a corona wire passing through the cleaning pad and positioning the cleaning pad in at least one direction lateral to the corona wire, and a holding member holding the cleaning pad without restraining the cleaning pad in the at least one direction lateral to the corona wire.

Figure 1:
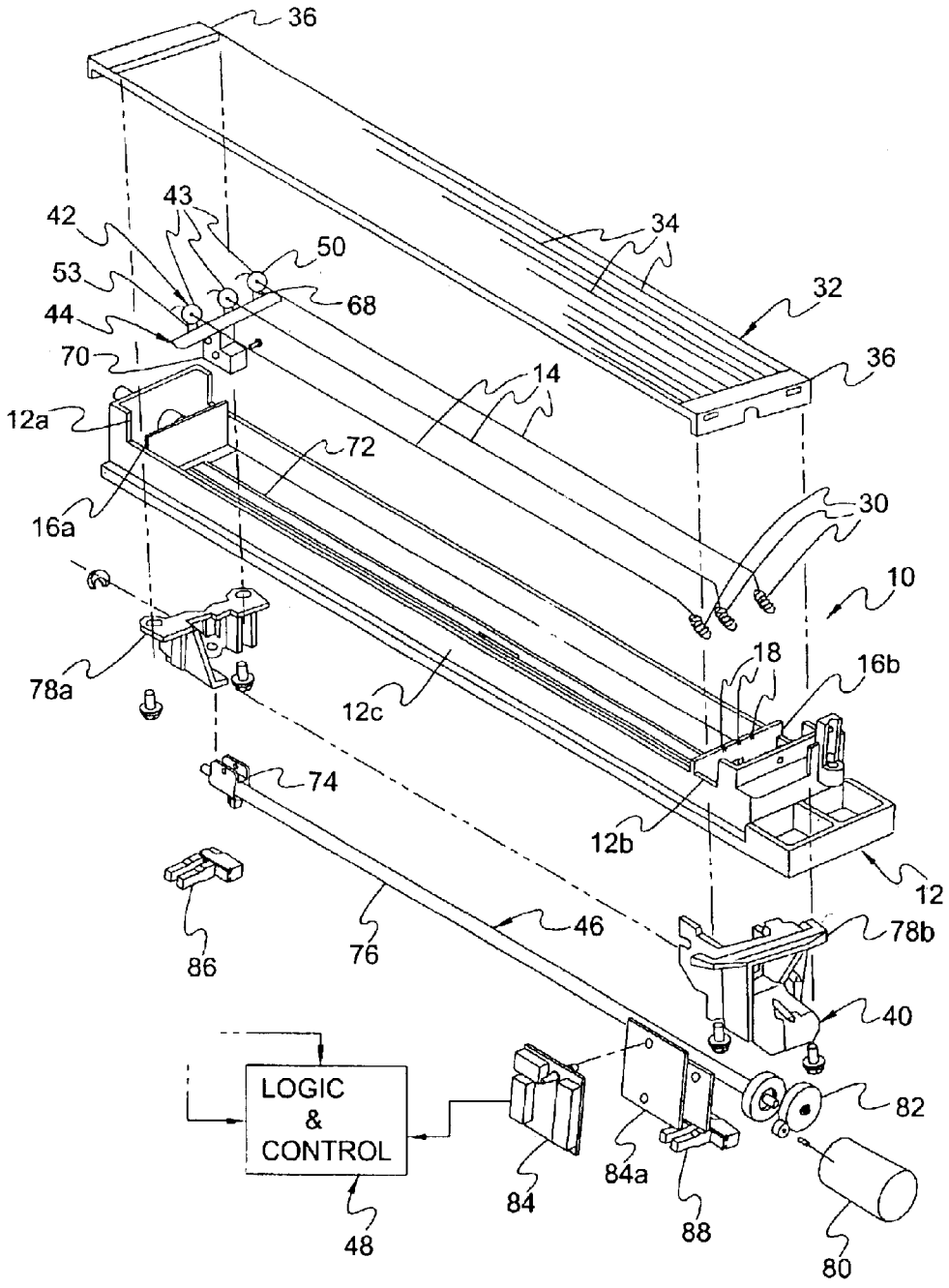
FIG. 1 is an exploded perspective view of a corona charger for an electrostatographic reproduction apparatus and an automatic cleaning mechanism, according to one embodiment.

For simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE PRESENTLY PREFERRED EMBODIMENTS

Figure 2:
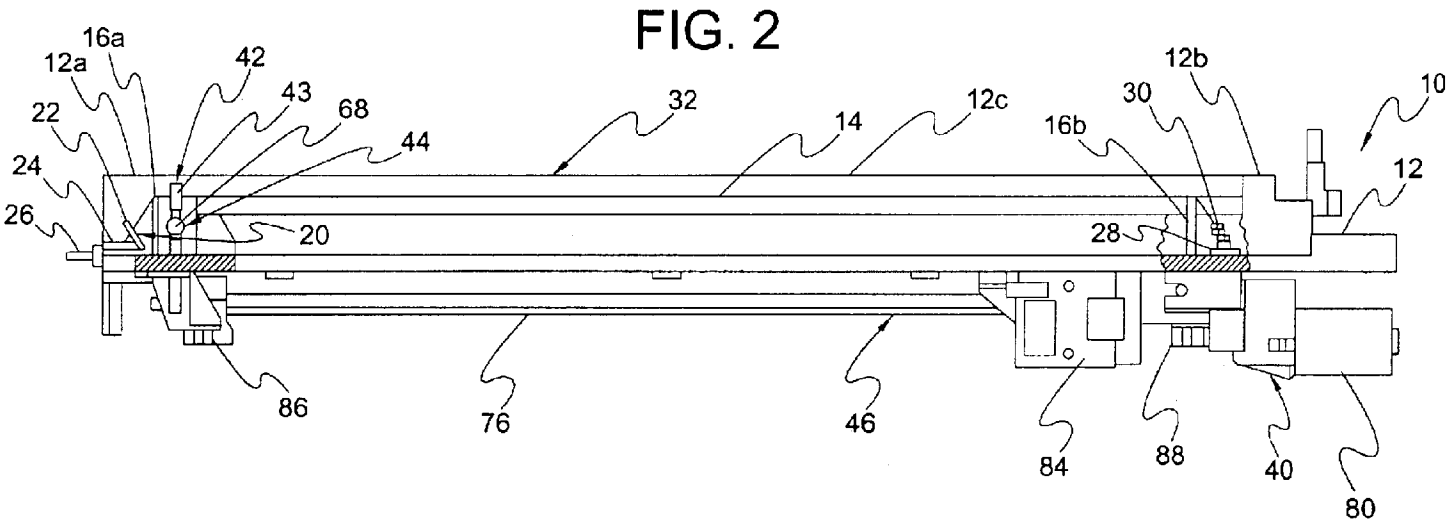
FIG. 2 is a side elevational view of the corona charger and automatic cleaning mechanism of FIG. 1, with portions broken away or in cross-section to facilitate viewing.

Referring now to the accompanying drawings, FIGS. 1 and 2 show a typical corona charger, designated generally by the numeral 10, for use in an electrostatographic reproduction apparatus such as copier/duplicators, printers, or the like. The corona charger 10 is utilized as discussed above for the general purpose of uniformly charging a surface in such well known electrostatographic reproduction apparatus. The corona charger 10 includes a housing shell 12, of a generally U-shaped cross-section with upstanding legs. The housing shell 12 has a first end portion 12*a* and a second end portion 12*b*, interconnected by an elongated central portion 12*c*, formed for example from an insulative resin material molded in the desired shape as shown. At least one corona wire 14 (three corona wires are shown in the illustrated embodiments) is supported to span the length of the central portion 12*c* of the housing shell. Preferably, the corona wire 14 has a thickness of less than two millimeters, and more preferably a thickness of less than one millimeter.

The central portion 12*c* is bounded at its ends by walls 16*a* and 16*b*. The walls 16*a* and 16*b* may be integrally formed with the housing shell 12, or may be separate structures connected to the housing shell in any well known manner. The top of the walls 16*a* and 16*b* are preferably rounded, and a plurality of notches 18 are respectively provided in the outboard sides of the walls adjacent to the tops thereof. The walls and notches support and locate the corona wires 14, whereby the surface to be charged can be brought into accurate spaced association with the corona wires 14. The rounding of the top of the walls 16*a* and 16*b* and the location of the notches 18 on the outboard sides thereof have an additional function which is discussed below.

An anchor assembly 20 (see FIG. 2) is provided in the first end portion 12*a* of the housing shell 12 for anchoring respective ends of the corona wires 14, and for electrically coupling a suitable electrical high voltage potential source to the corona wires 14. The anchor assembly 20 is formed of conductive material, such as metal for example. The anchor assembly 20 is connected by suitable fasteners to the housing shell 12, and has a plurality of tabs 22 (only one shown in FIG. 2) extending upwardly at an acute angle. The tabs 22 respectively define slots (not shown) at the ends thereof adapted to respectively receive corona wires 14. The corona wires 14 are, in turn, secured to the tabs 22 by knots (copper lugs for example) or loops formed in the ends of the corona wires 14.

Additionally, the anchor assembly 20 has a tab 24 connected to an electrical conductor 26 supported so as to extend through an end wall of the housing shell 12. The electrical conductor 26 is adapted to be coupled to a high voltage potential source (not shown), whereby the electrical potential of the source is applied to the corona wires 14 through the electrically conductive path described from the conductor, to the anchor assembly 20, and then to the corona wires.

The respective opposite ends of the corona wires 14 are connected to the housing shell 12, under preselected tension, by an anchor assembly 28 connected by suitable fasteners to the housing shell second end portion 12*b*. The anchor assembly 28 has a plurality of members adapted to respectively receive spring elements 30 connected to the ends of the corona wires respectively. Additionally, corona charger 10 has a charge control grid assembly 32 connected to the shell housing 12 so as to span the open area between the walls thereof. The charge control grid assembly 32 includes a plurality of very thin wires 34, running between end supports 36 connected to the end walls of the housing shell 12, substantially parallel to the corona wires 14. Preferably, the thin wires 34 have a thickness of less than two millimeters, and more preferably a thickness of less than one millimeter. The charge control grid assembly 32 may be coupled to an electrical potential source or to ground, in any well known manner, depending upon the desired control of the charge to be laid down by the corona charger 10.

In order to maintain the operating efficiency for the corona charger 10, an automatic cleaning mechanism designated generally by the numeral 40, according one embodiment, is provided for cleaning the primary operative surfaces of the corona wires 14 of the corona charger 10. The automatic cleaning mechanism 40 includes a cleaning assembly 42 removably mounted on a holding member 44. The holding member 44 is supported for linear movement along the longitudinal axis of the corona charger by a drive mechanism 46. The drive mechanism 46 is operatively associated with a control unit 48 for selectively activating the drive mechanism at desired predetermined intervals to accomplish the cleaning function. Alternatively, the holding member 44 and the cleaning assembly 42 may remain immobile, and the corona wires 14 moved, as disclosed, for example, in U.S. Pat. No. 6,108,504, the contents of which are fully incorporated by reference as if set forth herein.

Figure 4:
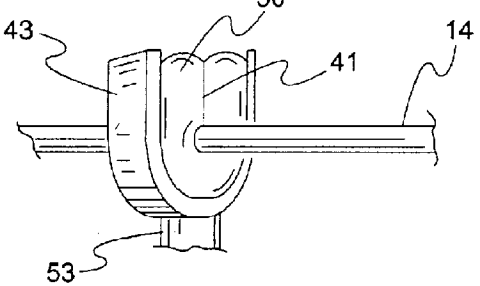
FIG. 4 is a perspective view of a pad holder and a cleaning pad for a cleaning assembly of an automatic cleaning mechanism, according to one embodiment.
Figure 3:
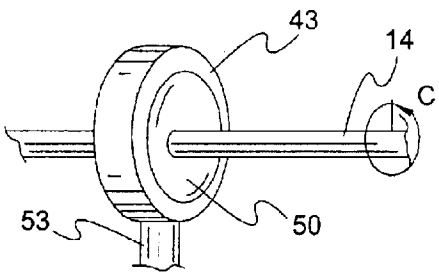
FIG. 3 is a perspective view of a pad holder and a cleaning pad for the cleaning assembly of the automatic cleaning mechanism of FIG. 1.

The cleaning assembly 42 includes at least one pad holder 43 mounted to at least one cleaning pad 50, as illustrated in FIGS. 3–4. The cleaning assembly 42 may include one pad holder 43 and one cleaning pad 50 for each corona wire 14 in corona charger 10, as illustrated in FIG. 1. The pad holder 43 is formed of a rigid materials, such as, for example, metals such as steel, aluminum, and brass, and plastics such as, Ethylene-vinyl acetate, Acrylics such as Acrylonitrile-butadiene-styrene and Acrylic-styrene-acrylonitrile, and Polymers such as Polycarbonate, Polyurethane, Polythylene, Polybutylene, Polyvinyl chloride, Polyphenylene oxide, Chlorinated polyvinyl chloride, Polyamides, and Polybutylene terephthalate. The cleaning pad 50 may be pliable, and may be comprised of a cleaning material in the form of a mildly abrasive cloth, such as, for example, NOMEX™ polyaramide cloth, cotton, and wool. Preferably, the cleaning pad is flame retardant as well. The pad holder is designed to hold the cleaning pad 50 in place and prevent the cleaning pad 50 from breaking apart during the cleaning of the corona wire 14.

The cleaning pad 50 is wrapped around a substantial portion of the corona wire 14, so that a substantial amount of the surface of the corona wire 14 can be cleaned by the automatic cleaning mechanism 40. Preferably, the cleaning pad 50 is wrapped around an amount of the corona wire more than a majority of and between 50 percent and 100 percent of the circumference C of the corona wire 14, as illustrated in FIGS. 3 and 4. As defined herein, the circumference C of the corona wire 14 is the distance around the external boundary of the corona wire 14, as illustrated in FIG. 3. For example, if the corona wire 14 is cylindrically shaped, then the circumference C would be defined as $\pi \cdot D$, whereas D is the diameter or thickness of the corona wire 14. However, the corona wire may take on many different shapes, having a square cross-section, a triangular cross section, or an irregular cross section, and therefore, the circumference C may vary depending on which shape the corona wire 14 takes on. More preferably, the cleaning pad 50 is wrapped around between 75 percent and 100 percent of the circumference of the corona wire 14, as illustrated in FIGS. 3 and 4. By wrapping the cleaning pad around between 50 percent and 100 percent of the circumference of the corona wire 14, then between 50 and 100 percent of the surface of the corona wire 14 can be cleaned by the automatic cleaning mechanism 40, unlike traditional apparatus used for cleaning the corona wires, which use a flat pad that only cleans about half the surface of the corona wire 14. Additionally, higher cleaning forces could be obtained without having to non-uniformly load the corona wire, as in conventional designs, and therefore allow for an increased life for the corona wire.

In one embodiment, the pad holder 43 forms a ring that surrounds the cleaning pad 50, as illustrated in FIG. 3. In this embodiment, the cleaning pad 50 is round and perforated by a hole. By way of example, without limiting the invention, the cleaning pad may be toroidal, annular, spherical, or bead-shaped. The cleaning pad 50 does not need to be round, and may be other shapes, by way of example, without limiting the invention, square, rectangular, or triangular. According to a preferred embodiment, the cleaning pad 50 extends continuously around the corona wire 14 without breaks, as shown in FIG. 3.

The corona wire 14 may be thread through the hole during assembly or maintenance of the automatic cleaning mechanism 40. Alternatively, the corona wire 14 may be thread through the hole in advance of assembly or maintenance of the automatic cleaning mechanism 40. In the latter, the cleaning pad 50 and corona wire 14 are pre-assembled, and the cleaning pad 50 is captive on the corona wire 14, thereby forming a single part.

According to one aspect of the invention, with reference to FIG. 3, a corona wire assembly is provided, comprising the corona wire 14, and the cleaning pad 50 having a hole, the corona wire extending through the hole. The cleaning pad 50 may be pliable or rigid. The assembly may further comprise the pad holder 43 mounted to the cleaning pad 50. The holding member 53 may be connected with the pad holder, and the holding member may include an arm to hold the cleaning assembly in a predetermined location relative to the corona wire.

According to one further aspect of the invention, a method is provided for cleaning a corona wire, comprising generating relative movement between the corona wire 14 and the cleaning pad 50, the corona wire 14 extending through a hole in the cleaning pad 50. The method may comprise immobilizing the corona wire 14 and moving the cleaning pad 50, for example using the apparatus of FIGS. 1 and 2, as described herein. The method may also comprise immobilizing the cleaning pad 50 and moving the corona wire 14, for example using the apparatus described in U.S. Pat. No. 6,108,504. Of course, other apparatus are possible and contemplated in the practice of the invention.

In another embodiment, the pad holder 43 and the cleaning pad 50 are both u-shaped, as illustrated in FIG. 4. Preferably, the cleaning pad 50 overlaps within the pad holder 43, as illustrated in FIG. 4, so that the corona wire 14 can be inserted into the cleaning assembly 42 through the gap 41 formed by the cleaning pad 50. Making both the cleaning pad 50 and the pad holder 43 u-shaped eases the assembly of the automatic cleaning mechanism 40.

Figure 3A:
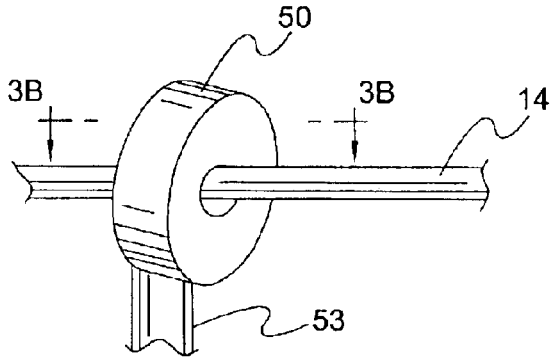
FIG. 3A is a perspective view of a cleaning pad for a cleaning assembly, according to one embodiment.
Figure 3B:
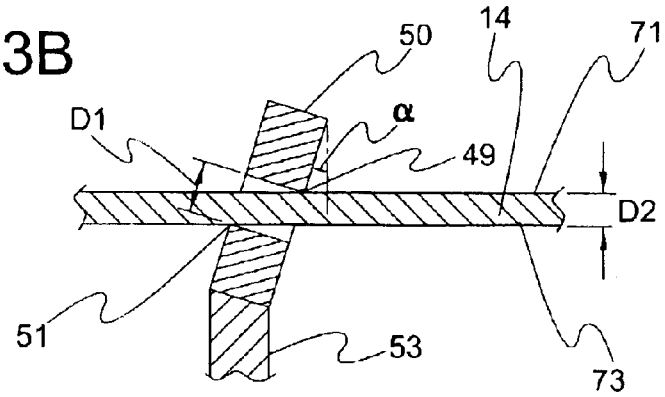
FIG. 3B is a side cross-sectional view of the cleaning pad shown in FIG. 3A.
Figure 3C:
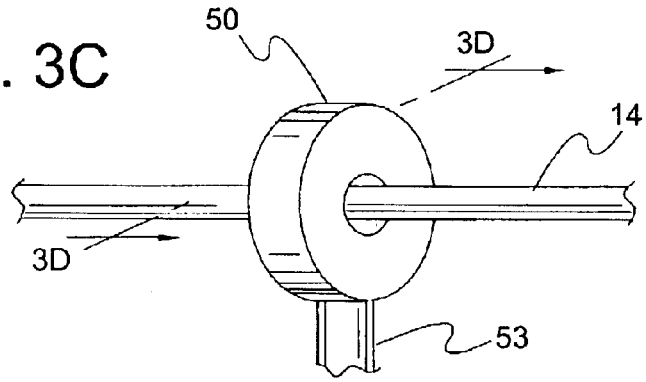
FIG. 3C is a perspective view of a cleaning pad for a cleaning assembly, according to one embodiment.
Figure 3D:
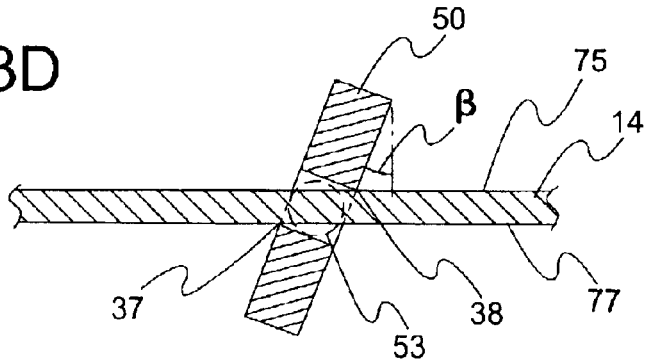
FIG. 3D is an overhead cross-sectional view of the cleaning pad shown in FIG. 3C.

In one embodiment, the cleaning assembly 42 includes a cleaning pad 50 made of a rigid, abrasive material such as aluminum oxide or silicon carbide, as illustrated in FIGS. 3A, 3B, 3C, and 3D. Preferably, the cleaning assembly 42 includes one cleaning pad 50 for each corona wire 14 in corona charger 10. Preferably, the cleaning pad 50 is toroidally shaped. The inside diameter D1 of the cleaning pad 50 is larger than the diameter D2 of the corona wire 14 allowing the corona wire 14 to be more easily threaded through the cleaning pad 50. Preferably, cleaning pad 50 is tilted an angle a relative to a line normal to the direction of corona wire 14, as illustrated in FIG. 3B. Cleaning pad 50 is tilted at an angle $\alpha$ so that cleaning pad 50 contacts corona wire 14 at at least two edges 49 and 51 in order to aggressively clean the top 71 and bottom 73 of the corona wire 14 during the cleaning cycle, as illustrated in FIGS. 3A and 3B. Furthermore, the cleaning pad 50 could also be tilted an angle $\beta$ relative to a line normal to the direction of corona wire 14, as illustrated in FIGS. 3C and 3D. Cleaning pad 50 is tilted at an angle $\beta$ so that cleaning pad 50 contacts corona wire 14 at at least two edges 37 and 38 in order to aggressively clean the first side 75 and second side 77 of the corona wire 14 during the cleaning cycle, as illustrated in FIGS. 3C and 3D.

In one embodiment, the holding member 44 for the cleaning assembly 42 includes an arm 68 that respectively define slots adapted to receive legs 53 projecting from the pad holder 43 of the cleaning assembly 42, as illustrated in FIGS. 1 and 3. The arm 68 holds the assembly in a predetermined location relative to the corona wires 14, and particularly the primary operative surfaces thereof. Preferably, the arm 68 and the cleaning assembly 42 are integrally formed in order to reduce assembly time.

The holding member 44 is connected with the drive mechanism 46, wherein the drive mechanism 46 moves the holding member along a fixed path. The drive mechanism 46 is any mechanism known to one of ordinary skill in the art that can move an object along a fixed path, and can comprise such devices as a motor, a pulley, a gear, a screw, a shaft, a magnet, or any other devices or combination of devices which can be used to move an object along a path known to one of ordinary skill.

In one embodiment, the holding member 44 has a depending leg 70 which extends through a longitudinally oriented slot 72 defined in the corona charger housing shell 12. The remote end of the leg 70 is connected to a traveling nut 74 mounted on a lead screw 76. The lead screw 76 is supported in bearing blocks 78*a* and 78*b* attached to the housing shell 12 respectively adjacent to the portions 12*a* and 12*b* thereof. A bi-directional motor 80, mounted on the bearing block 78*b*, is coupled to the lead screw 76 through a gear combination 82. When the bi-directional motor 80 is activated in either direction, the lead screw 76 is correspondingly rotated in a one direction or in the opposite direction about its longitudinal axis. Due to the interaction of the leg 70 of the holding member 44 with the slot 72, the traveling nut 74 is restrained from rotation with the lead screw 76 by the attachment to the leg confined by slot 72. Accordingly, rotation of the lead screw will cause the traveling nut to move in a linear direction along the longitudinal axis of the lead screw. Of course, movement of the traveling nut 74 causes a corresponding linear movement of the holding member 44 and thus the cleaning assembly 42. Such movement of the cleaning assembly 42 brings the cleaning pad 50 into operative cleaning relation with at least the operative surfaces of the corona wires 14 to effect efficient cleaning thereof. It should be understood that a motor rotating the lead screw 76 in a single direction, with the lead screw 76 being of the double helix type, is also suitable for use with this invention.

The automatic control of the automatic cleaning mechanism 40 for the corona charger 10, as noted above, is effected by the logic and control unit 48. The logic and control unit 48 includes a circuit board 84 mounted on a bracket 84*a* attached to the bearing block 78*b*. The circuit board 84 has a microprocessor which receives input signals and timing signals. Based on such signals and a program for the microprocessor, the logic and control unit 48 produces signals to control the timing and operation of the bi-directional motor 80. The production of a program for a number of commercially available microprocessors, which are suitable for use with the invention, is a conventional skill well understood in the art. The particular details of any such program would, of course, depend on the architecture of the designated microprocessor. Of course, the microprocessor may be remotely located from the circuit board; such as for example it may be part of a main logic and control unit of the reproduction apparatus with which the corona charger is associated. Certain input signals for the microprocessor of the control unit 48 are provided by a home position switch 86 and a reversing switch 88. The home position switch 86 is a home position sensor located adjacent to the first end portion 12*a* of the corona charger housing shell 12. When the cleaning assembly 42 is in the home position (see FIG. 2), it is located so as to be out of contact with the working area of the corona wires 14.

At predetermined intervals, the logic and control unit 48 activates the bi-directional motor 80 to rotate the lead screw 76 in one direction or in the opposite direction. When the cleaning assembly 42 has fully traversed the working area of the corona wires 14, to a remote position from the home position, the traveling nut 74 will contact the reversing switch 88. An appropriate signal will be sent to control unit 48 to cause the bi-directional motor 80 to reverse its direction of operation, and thus rotate the lead screw 76 in the opposite direction. Accordingly, the direction of travel for the traveling nut 74 will be reversed and the cleaning assembly 42 will be moved in the opposite direction toward the home position. When the cleaning assembly 42 reaches the home position, the home position switch 86 will send an appropriate signal to the control unit 48 to cause the bi-directional motor 80 to stop. The cleaning assembly 42 will be maintained in the home position, out of the way of the operation of the corona charger 10, until the next desired cleaning interval. For example, a cleaning cycle may be initiated on start up of the reproduction apparatus, and also on apparatus cycle out after every 10,000 images, or may selectively be initiated at the discretion of the operator. Of course the number of images between cleaning cycles is programmable by the logic and control unit 48 to achieve the most efficient operation of the automatic cleaning mechanism 40.

Figure 5:
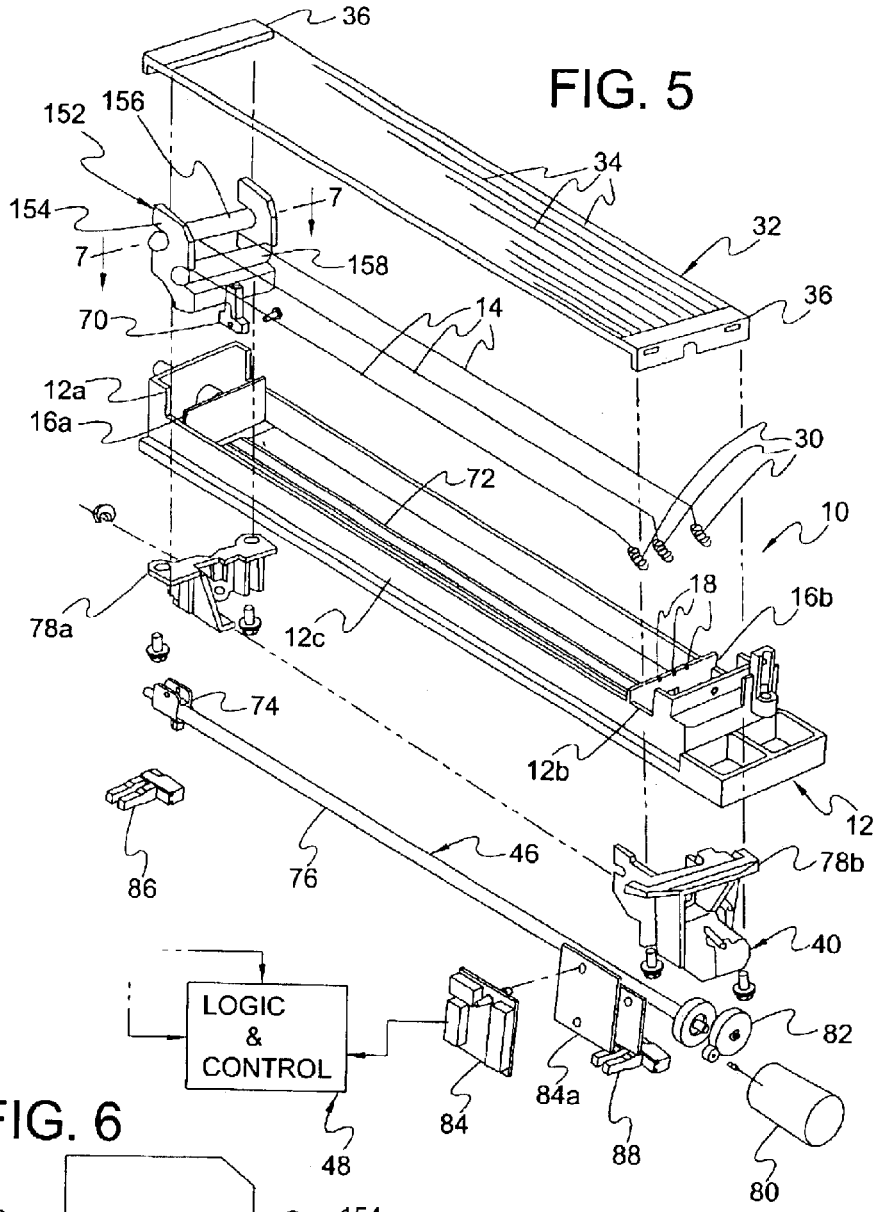
FIG. 5 is an exploded perspective view of a corona charger for an electrostatographic reproduction apparatus and an automatic cleaning mechanism, according to one embodiment.

In one embodiment, the cleaning assembly 152 includes a stone holder 154 formed, for example, of plastic material, as illustrated in FIG. 5. At least one finishing stone 156 is mounted onto the stone holder 154. The finishing stone 156 is comprised of a cleaning material in the form of a hard, abrasive material, such as, for example, aluminum oxide, and silicon carbide. The stone holder 154 is designed to hold the finishing stone 156 in place and prevent the finishing stone 156 from moving in relation to the stone holder 154 during the cleaning of the corona wire 14. The finishing stone 156 engages the surface of the corona wire 14, so that crystalline deposits that are adhered to the surface of the corona wire 14 can be removed by the automatic cleaning mechanism 40. Preferably, the finishing stone 156 is cylindrically shaped, so as to more easily glide over the surface of the corona wires 14, however, the finishing stone 156 may take the form of other shapes, such as, for example, a parallelogram, a cone, or any shape contemplated by one of ordinary skill in the art.

Figure 7:
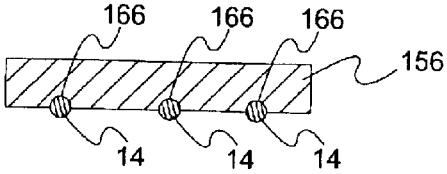
FIG. 7 is a cross-sectional view, of a finishing stone for the cleaning assembly of the automatic cleaning mechanism of FIG. 5.

In one embodiment, the finishing stone 156 includes at least one groove 166, as illustrated in FIG. 7. Groove 166 allows finishing stone 156 to engage a greater amount of the surface of the corona wire 14, so that a greater amount of the surface of the corona wire 14 may be cleaned.

Figure 6:
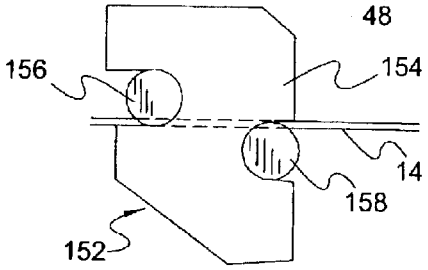
FIG. 6 is a side view of a holding member for the cleaning assembly of the automatic cleaning mechanism of FIG. 5.

In one embodiment, a second finishing stone 158 is mounted onto the stone holder 154, as illustrated in FIGS. 5 and 6. The second finishing stone 158 engages the surface of the corona wire 14, so that crystalline deposits that are adhered to the surface of the corona wire 14 can be removed by the automatic cleaning mechanism 40. Preferably, the first finishing stone 156 is opposed to the second finishing stone 158 so that opposing sides of the corona wire 14 may be cleaned, as illustrated in FIGS. 5 and 6. The cleaning assembly 152 is connected with the drive mechanism 46, wherein the drive mechanism 46 moves the cleaning assembly 152 along a fixed path. In one embodiment, the cleaning assembly 152 has a depending leg 70 which extends through a longitudinally oriented slot 72 defined in the corona charger housing shell 12. The remote end of the leg 70 is connected to a traveling nut 74 mounted on a lead screw 76, the rest of which is as described above.

While in the above-described embodiments the automatic cleaning mechanism is used to clean corona wires 14, the automatic cleaning mechanism 40 can also be used to clean the thin wires 34 of the charge control grid assembly 32, as will be appreciated by those of skill in the art. Additionally, while in the above-described embodiments the automatic cleaning mechanism 40 includes either the cleaning assembly 42 or the cleaning assembly 152, the automatic cleaning mechanism 40 may include both the cleaning assembly 42 and the cleaning assembly 152 in order to clean different types of particulates.

Figure 9:
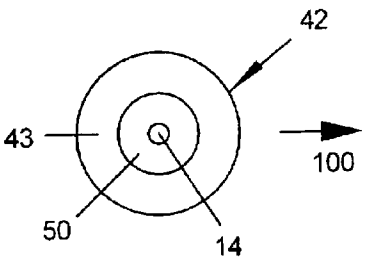
FIG. 9 is an end view of the corona wire and cleaning assembly taken along line 9—9 of FIG. 8.
Figure 8:
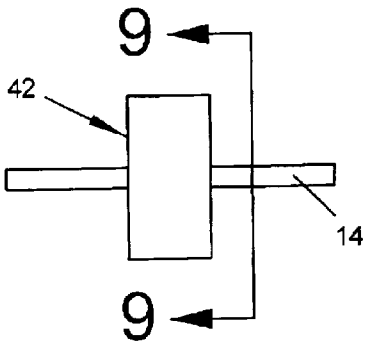
FIG. 8 is a side view of a corona wire and cleaning assembly having a ring-shaped pad holder and a round cleaning pad.
Figure 12:
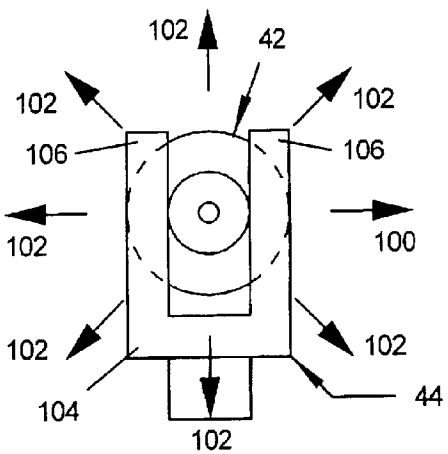
FIG. 12 is an end view taken along line 12—12 of FIG. 11.
Figure 11:
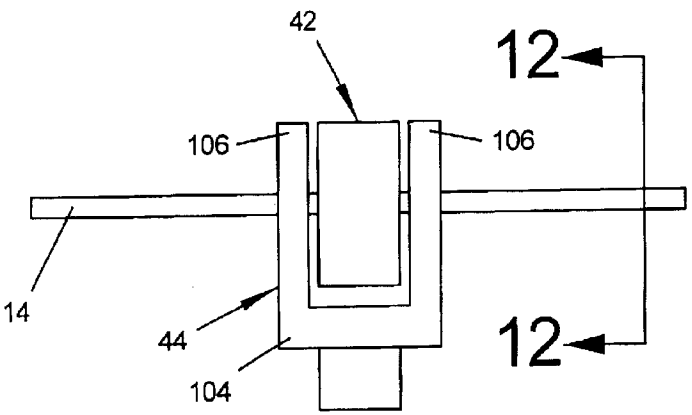
FIG. 11 is a side view of the FIG. 8 corona wire and cleaning assembly in combination with a holding member having four arms.

Referring now to FIGS. 8 and 9, another embodiment of a cleaning mechanism for cleaning the surface of a corona wire within a corona charger is presented. The cleaning assembly 42 comprises the pad holder 43 and the cleaning pad 50 mounted to the pad holder 43, although the pad holder 43 may or may not be implemented depending upon whether the cleaning pad 50 is self-supporting. The corona wire 14 passes through the cleaning pad 50 and positions the cleaning pad 50 or cleaning assembly 42 in at least one direction 100 lateral to the corona wire 14. Referring now to FIGS. 11 and 12, the holding member 44 holds the cleaning pad 50 or cleaning assembly 42 without restraint in the at least one direction 100 lateral to the corona wire 14. Thus, the position of the corona wire 14 determines the position of the cleaning pad 50 or cleaning assembly 42 with respect to the at least one direction 100. The position of the corona wire 14 is determined upon assembly of the corona charger 10, for example by the housing shell 12 and notches 18 (FIG. 1). According to a preferred embodiment, the corona wire 14 passes through the cleaning pad 50 and positions the cleaning pad 50 or cleaning assembly 42 in all directions 100, 102 lateral to the corona wire 14, the holding member 44 engaging the cleaning pad 50 or cleaning assembly 42 without restraint in all the directions 100, 102 lateral to the corona wire 14. In this embodiment the holding member 44 may comprise a base 104 and four upright fingers 106 that define a space. The cleaning pad 50 or cleaning assembly 42 is received within the space, preferably loosely, free to float in all directions lateral to the corona wire 14. Upon movement of the holding member 44 along the length of the corona wire 14, or lengthwise movement of the corona wire 14 relative to the holding member 44, the holding member 44 engages the cleaning assembly with a corresponding pair of fingers 106.

Figure 10:
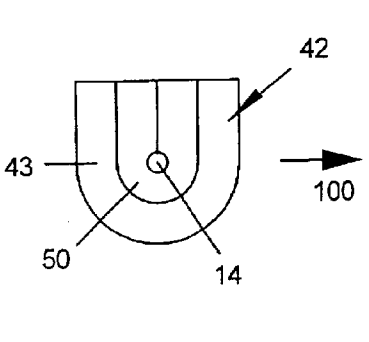
FIG. 10 is an end view of a corona wire and cleaning pad assembly having a u-shaped pad holder and cleaning pad.

According to one aspect of this embodiment, the pad holder 43 may have a variety of shapes, for example a ring, as shown in FIG. 9, or u-shaped as shown in FIG. 10. Similarly, the cleaning pad 50 may have a variety of shapes, for example, round, as shown in FIG. 9, or unshaped as shown in FIG. 10.

Thus, there has been disclosed in accordance with the invention, a method and apparatus for cleaning a corona wire that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications that fall within the scope of the amended claims and equivalents thereof.

What is claimed is:

1. A corona wire assembly, comprising:

a corona wire; and, a cleaning pad having a hole, the corona wire extending through the hole;

wherein the cleaning pad is rigid.

2. The corona wire assembly of claim 1, further comprising a pad holder mounted to the cleaning pad.

3. The corona wire assembly of claim 1, further comprising a pad holder mounted to the cleaning pad, and a holding member connected with the pad holder.

4. The corona wire assembly of claim 1, further comprising a pad holder mounted to the cleaning pad, and a holding member connected with the pad holder, wherein the holding member includes an arm to hold the cleaning assembly in a predetermined location relative to the corona wire.

5. The corona wire assembly of claim 1, wherein said cleaning pad is tilted relative to said corona wire.

6. A method for cleaning a corona wire, comprising:

generating relative movement between a corona wire and a cleaning pad having a hole, the corona wire extending through the hole;

wherein the cleaning pad is rigid.

7. The method of claim 6, further comprising immobilizing the corona wire and moving the cleaning pad.

8. The method of claim 6, further comprising immobilizing the cleaning pad and moving the corona wire.

9. The method of claim 6, further comprising a pad holder mounted to the cleaning pad.

10. The method of claim 6, further comprising threading the corona wire through the hole.

11. The method of claim 6, further comprising tilting said cleaning pad relative to said corona wire.

12. A cleaning mechanism for cleaning the surface of a corona wire within a corona charger, the cleaning mechanism comprising:

a cleaning pad;

a corona wire passing through the cleaning pad and positioning the cleaning pad in at least one direction lateral to the corona wire; and, a holding member holding the cleaning pad without restraining the cleaning pad in the at least one direction lateral to the corona wire.

13. The cleaning mechanism of claim 12, further comprising a pad holder mounted to the cleaning pad, the holding member holding the pad holder and cleaning pad.

14. The cleaning mechanism of claim 13, wherein the pad holder is a ring.

15. The cleaning mechanism of claim 13, wherein the pad holder is u-shaped.

16. The cleaning mechanism of claim 12, wherein the cleaning pad is round.

17. The cleaning mechanism of claim 12, wherein the cleaning pad is u-shaped.

18. The cleaning mechanism of claim 12, the corona wire passing through the cleaning pad and positioning the cleaning pad in all directions lateral to the corona wire; the holding member holding the cleaning pad without restraining the cleaning pad in the all directions lateral to the corona wire.

* * * * *